US005115740A

United States Patent [19]

Emrich et al.

[11] Patent Number: 5,115,740

[45] Date of Patent: May 26, 1992

[54] SHEET-FEED DRUM IN ROTARY PRESSES

[75] Inventors: Helmut Emrich, Offenbach/Main; Uwe Sabrowski, Dreieich, both of Fed. Rep. of Germany

[73] Assignee: MAN Roland Druckmaschinen AG, Fed. Rep. of Germany

[21] Appl. No.: 579,485

[22] Filed: Sep. 10, 1990

[30] Foreign Application Priority Data

Sep. 14, 1989 [DE] Fed. Rep. of Germany ..... 3930747

[51] Int. Cl.[5] ..... B41F 21/00; B41L 21/02

[52] U.S. Cl. ..... 101/420; 101/422

[58] Field of Search ..... 101/420, 422

[56] References Cited

U.S. PATENT DOCUMENTS

| | | | |
|---|---|---|---|
| 3,054,348 | 9/1962 | Gutweniger | 101/420 |
| 3,308,522 | 3/1967 | Miller | 101/420 X |
| 3,642,274 | 2/1972 | Herrington et al. | 101/420 X |
| 4,060,238 | 11/1977 | Simeth | 101/422 X |
| 4,846,062 | 7/1989 | Difflipp et al. | 101/420 X |

FOREIGN PATENT DOCUMENTS

| | | |
|---|---|---|
| 1891447 | 4/1964 | Fed. Rep. of Germany . |
| 1179559 | 10/1964 | Fed. Rep. of Germany . |
| 972487 | 10/1964 | United Kingdom . |

*Primary Examiner*—Edgar S. Burr
*Assistant Examiner*—Moshe I. Cohen
*Attorney, Agent, or Firm*—Leydig, Voit & Mayer

[57] ABSTRACT

An improved sheet-feed drum for guiding and transferring sheets in a rotary printing press is provided with a plurality of round brushes rotatably mounted in closely spaced relation on a plurality of longitudinally extending supporting rods disposed about the periphery of the drum substantially parallel to the drum axis. The brushes are disposed on the support rods over the entire width of the sheets and have bristles made of an ink-repellent material.

2 Claims, 2 Drawing Sheets

SHEET-FEED DRUM IN ROTARY PRESSES

FIELD OF THE INVENTION

The present invention relates generally to sheet-feed or transfer drums in rotary printing presses and more particularly concerns such drums with rotary brushes on the periphery thereof to substantially eliminate ink smearing of the freshly printed sheets during sheet feeding and transfer.

BACKGROUND OF THE INVENTION

In conventional sheet-feed rotary printing presses, it is common to employ sheet-feed, turning or transfer drums to convey and guide the freshly printed sheets from one impression cylinder to another or to a subsequent printing or delivery station. When the rotating surface of the drum engages the freshly printed surface of the sheet smearing of the ink frequently occurs due to the slight differential speed of the sheet and the supporting drum surface.

Sheet transfer and turning drums including a plurality of rod supported rollers on their peripheries are known in the prior art as shown in GB Pat. No. 972,487 and U.S. Pat. No. 4,846,062. One disadvantage of these drum arrangements, however, is that unless the peripheral rollers and/or rods are adjusted axially so the rollers engage print free spaces on the sheets, ink smearing and smudging of the printed images still frequently occurs.

In U.S. Pat. No. 3,054,348 another type of sheet-feed drum is disclosed having a peripheral surface formed by a plurality of brush rings having the same diameter as the drum and disposed in side-by-side, spaced-apart relation along the drum axis. The brush rings are secured to discs rotatably disposed on the drum shaft and the freshly-printed sheets are supported and conveyed on a number of bristles of the brush rings. However, because relative motion still occurs between the sheet and the brush ring, particularly when chain gripper take-off conveyors are used, smudging and scratching of the printed image by the ring brush bristles cannot be completely avoided.

OBJECTS AND SUMMARY OF THE INVENTION

Accordingly, it is the primary aim of the present invention to provide a sheet-feed drum in rotary printing presses with sheet-carrying brush members which do not move relative to the freshly-printed side of the sheet.

It is a further object to provide such brush members with bristles made of an ink-repellent material to which little, if any, ink adheres and which may be easily cleaned.

Pursuant to the invention, a plurality of small round brushes are rotatably mounted on a plurality of longitudinally extending support rods disposed about the periphery of the sheet-feed drum substantially parallel to the central axis thereof. The brushes are mounted in closely spaced axial relation on the support rods and are disposed over substantially the entire width of the sheets.

Owing to the ease of rotation of the round brushes and their small mass moment of inertia, the brushes do not tend to move relative to the sheets. Moreover, because the brush bristles constitute flexible supporting points for the sheets, ink smearing and smudging of the freshly printed image is substantially completely eliminated, even in the case of sheet-feed drums guided on chain.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figure 1:
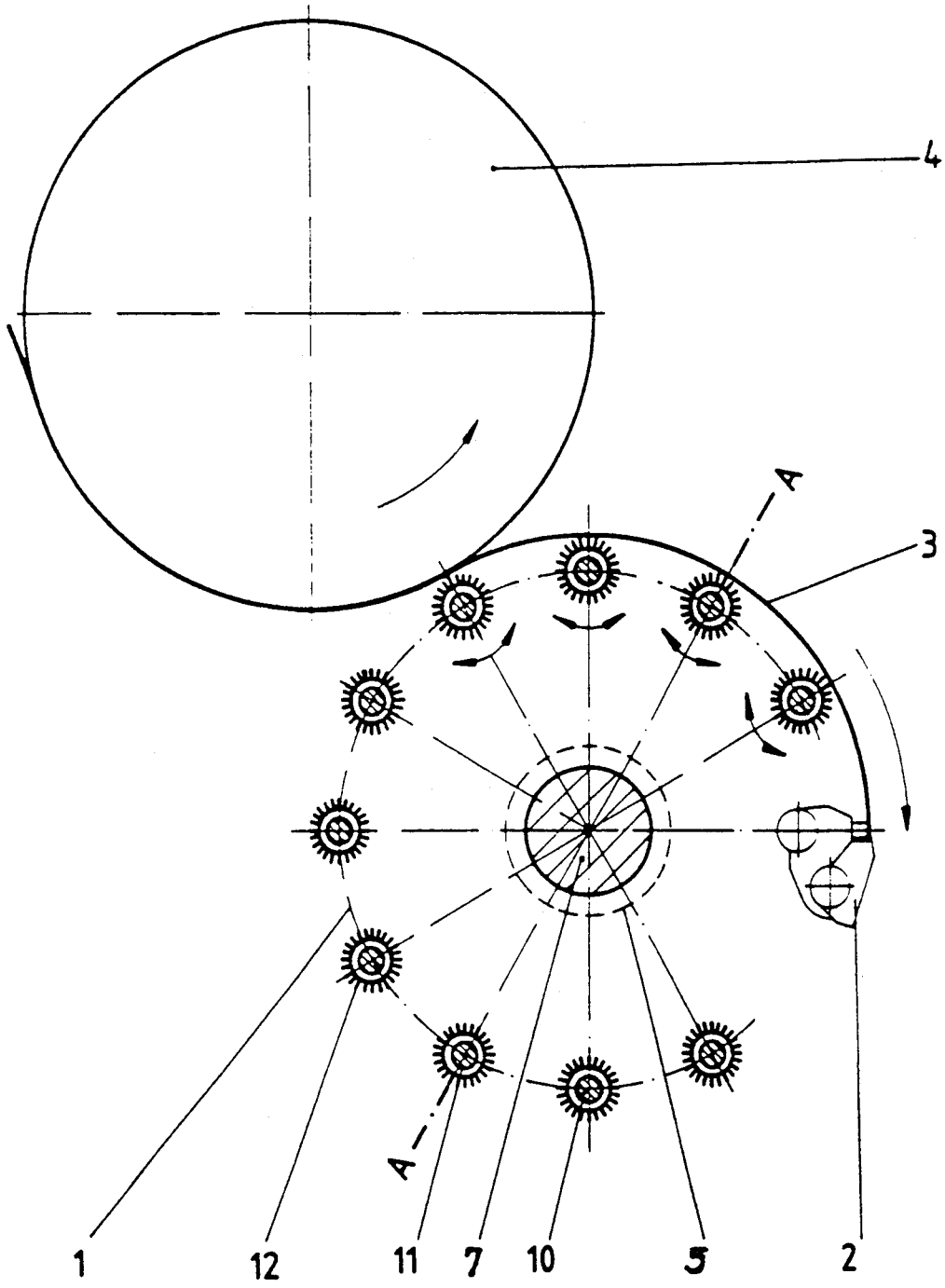
FIG. 1 is a generally diagrammatic cross-section through an impression cylinder and a sheet-feed drum of a rotary printing press illustrating a sheet being removed from the impression cylinder and supported on brushes mounted on the periphery of the sheet-feed drum.
Figure 2:
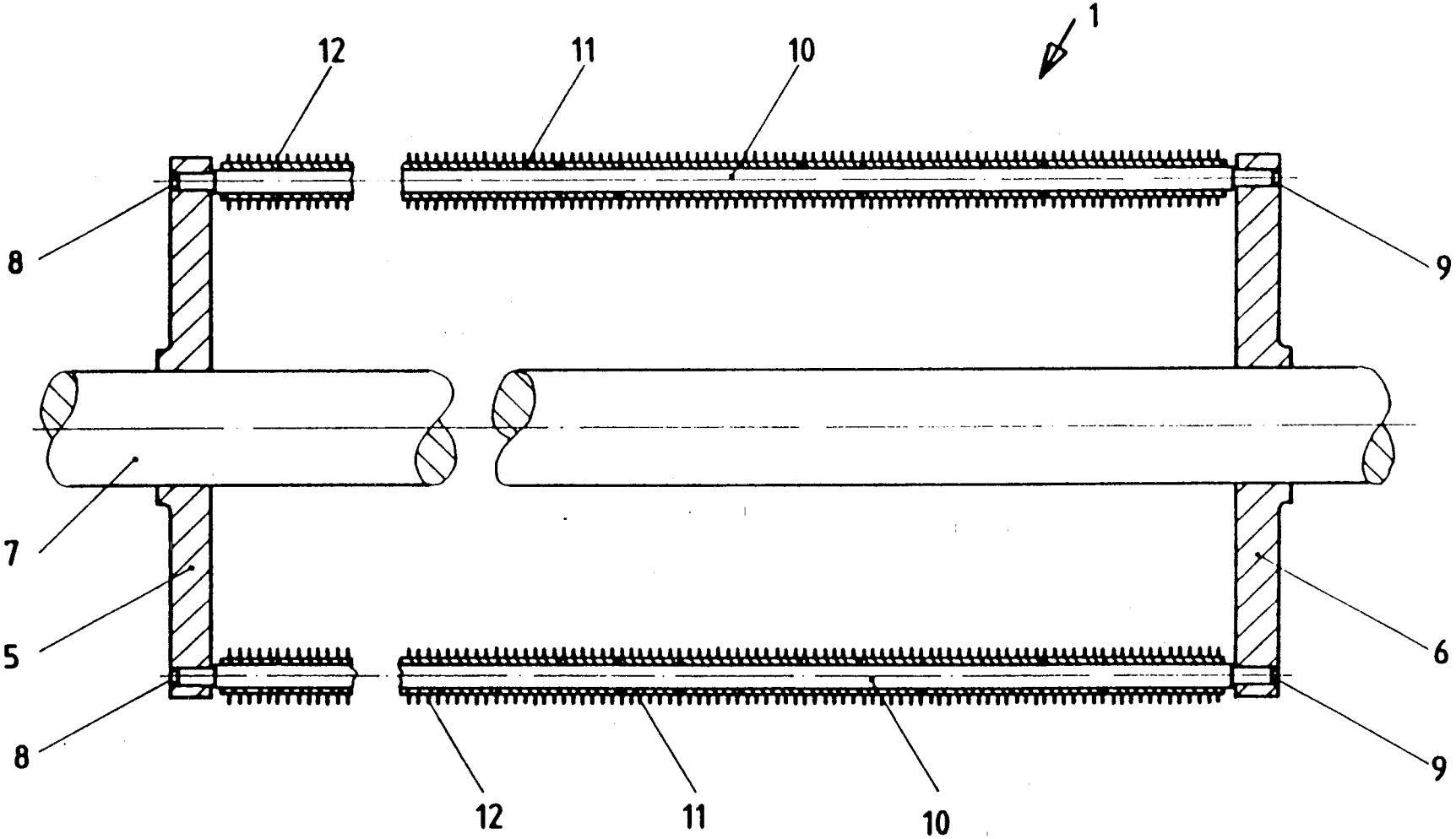
FIG. 2 is a somewhat diagrammatic longitudinal section of the sheet-feed drum, substantially as seen in the plane A—A in FIG. 1, showing only the round brushes disposed in the plane A—A.

Turning now to the drawings, a portion of a rotary printing press is shown generally diagrammatically in FIG. 1. As shown here, a sheet-feed drum 1 which includes a gripper system 2 has just received a freshly printed sheet 3 from an upstream impression cylinder 4. It will be understood that the sheet 3 is conveyed by the drum 1 to a downstream printing group or to a sheet-delivery station (not shown). The sheet-feed drum 1 preferably has two circular sector-shaped end plates 5 and 6 which are firmly secured to the drum shaft 7, as shown in FIG. 2.

Pursuant to the present invention, the ends of a plurality of longitudinally extending support rods 10 are inserted into facing bores 8 and 9 located adjacent the periphery of the end plates 5 and 6 of the drum 1. The support rods 10 are disposed substantially parallel to the axis of the drum 1 and shaft 7. In further accordance with the invention, a plurality of small round brushes 11 are mounted in closely spaced axial relation so as to be freely rotatable on the support rods 10 without gaps over substantially the entire width of the sheet 3.

In keeping with another aspect of the invention, the bodies of the brushes 11 are preferably cylindrical but the bristles 12 of the brushes 11 can have a different outer contour or profile, e.g., spherical. The bristles 12 can extend generally radially outwardly from the brush bodies or the bristles can slant from the brush bodies, if desired.

Preferably, the bristles 12 of the brushes 11 are made of an ink-repellent material such as nylon or polyester or the like and although the bristles 12 are generally flexible, they are sufficiently rigid to support the sheet 3. It will be understood that the ink-repellent bristles 12 are very easy to clean, for example by dry rubbing or by wet washing with conventional detergent solutions, but cleaning is usually necessary only after prolonged use. In an alternative embodiment, the support rods 10 can be spring mounted in axially resilient sockets or bores in a well known manner (not shown) so that the complete rods 10 and brushes 11 can be easily replaced or removed for cleaning.

We claim as our invention:

1. In a sheet-feed drum for guiding and transferring sheets in a rotary printing press, wherein said drum has an outer periphery and a central axis, the improvement comprising, means for securing a plurality of longitudinally extending support rods about said outer periphery of the drum substantially parallel to said central axis, and a plurality of round brushes rotatably mounted on said support rods for engaging and guiding said sheets, said brushes having generally cylindrical bodies with a multiplicity of generally flexible bristles made of an ink-repellant material projecting outwardly from substantially the entire surface of said cylindrical brush bodies, and said brushes being mounted so as to be freely rotatable with respect to said central axis and disposed in closely spaced axial relation on said support rods substantially without gaps over substantially the entire width of said sheets.

2. The improved sheet-feed drum according to claim 1 wherein said bristles extend generally radially outward from said brush bodies.

* * * * *